US006015225A

United States Patent [19]

Williams

[11] Patent Number: 6,015,225

[45] **Date of Patent: *Jan. 18, 2000**

[54] VIBRATION INPUT TO MOVING AQUEOUS CEMENTITIOUS SLURRY

[75] Inventor: Richard A. Williams, Dana Point, Calif.

[73] Assignee: Matrix Master Inc., Newport Beach, Calif.

[ * ] Notice: This patent is subject to a terminal disclaimer.

[21] Appl. No.: 08/909,644

[22] Filed: Aug. 12, 1997

Related U.S. Application Data

[63] Continuation-in-part of application No. 08/615,597, Mar. 13, 1996, Pat. No. 5,813,754.

[51] Int. Cl.[7] ..... B28C 5/16; B01F 11/00

[52] U.S. Cl. ..... 366/6; 366/65; 366/114; 366/120; 366/123; 366/137; 366/314

[58] Field of Search ..... 366/2, 6, 14, 15, 366/31, 32, 108, 65, 110–126, 141, 314, 136, 137

[56] References Cited

U.S. PATENT DOCUMENTS

| | | | |
|---|---|---|---|
| 2,673,811 | 3/1954 | Tsunoda | 366/114 |
| 3,006,615 | 7/1961 | Mason, Jr. . | |
| 3,295,838 | 1/1967 | Ban . | |
| 3,601,369 | 8/1971 | Wahl . | |
| 4,106,111 | 8/1978 | Rose . | |
| 4,302,112 | 11/1981 | Steenstrup . | |
| 4,588,299 | 5/1986 | Brown et al. . | |
| 4,830,505 | 5/1989 | Dunton et al. . | |
| 4,904,089 | 2/1990 | Dunton et al. . | |
| 5,395,593 | 3/1995 | Martin . | |

FOREIGN PATENT DOCUMENTS

| | | | |
|---|---|---|---|
| 2399273 | 4/1979 | France . | |
| 181622 | 4/1966 | U.S.S.R. . | |
| 197514 | 8/1967 | U.S.S.R. . | |
| 289932 | 2/1971 | U.S.S.R. . | |
| 1339028 | 9/1987 | U.S.S.R. . | |
| 1606173 | 11/1990 | U.S.S.R. . | |
| 2091117 | 7/1982 | United Kingdom . | |
| 96/00640 | 1/1996 | WIPO | 366/65 |

*Primary Examiner*—Charles E. Cooley
*Attorney, Agent, or Firm*—William W. Haefliger

[57] ABSTRACT

The method of treating an aqueous, cementitious slurry, to enhance fluidity, that includes providing a container for the slurry and effecting movement of the slurry via an impeller, in the container, and locating at least one vibrator in the interior of the vessel, and operating the vibrator to transmit vibration to the moving slurry.

63 Claims, 7 Drawing Sheets

159
161
150
160
214
192
151b
158
191
178a
190
165
165
151
167
157a
165a
178
7
155
7
157
170
171
152
180
151a
153
154
156
DRIVE

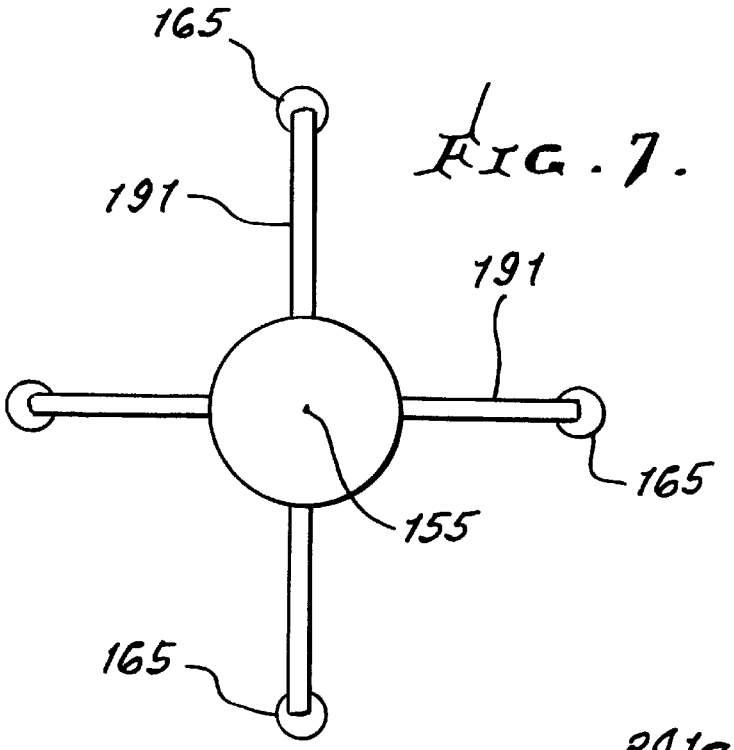
FIG. 7.
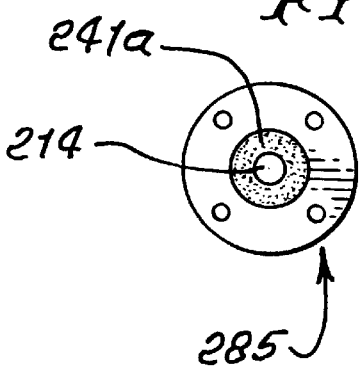
FIG. 9.
FIG. 8.
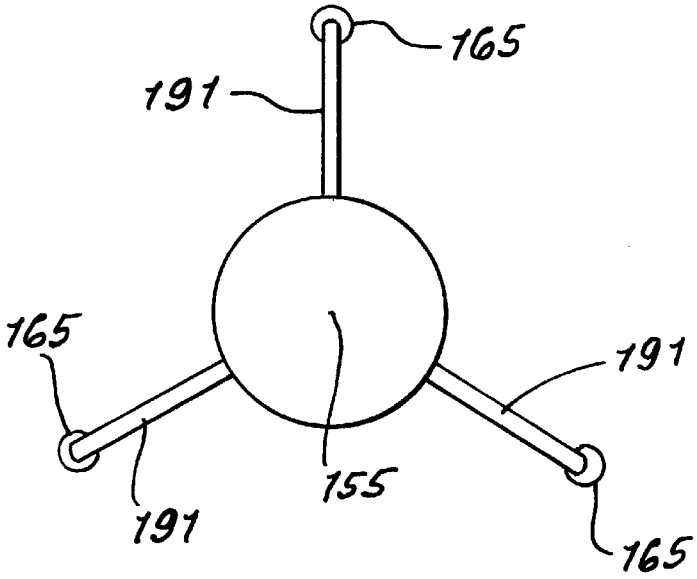

VIBRATION INPUT TO MOVING AQUEOUS CEMENTITIOUS SLURRY

This application is a continuation-in-part of prior U.S. patent application Ser. No. 08/615,597, filed Mar. 13, 1996, now U.S. Pat. No. 5,813,754.

BACKGROUND OF THE INVENTION

This invention relates generally to the enhancement of fluidity of aqueous cementitious slurries; and more particularly concerns transmission of vibration into such slurries which are moving, as in mixing vessels, thereby to achieve lower water cement ratios.

A typical concrete batch contains proportionally 500 pounds of cement, 267 pounds of water, 1,350 pounds of dry sand, and 1,850 pounds of coarse aggregate. Since the sand is normally added in wet condition, the batch weight (as measured) of added materials is typically 500 pounds of cement, 200 pounds of water, 1,417 pounds of wet sand (5% water), and 1,850 pounds of aggregate. This works out to a water/cement ratio of 0.40 in the water/cement slurry mixing vessel. If fluidity or flowability of the mix could be enhanced, more cement could be added to mix with water, and less dry cement would be required to be added to the ready-mix truck mixing vessel, reducing dust creation. A desired water/cement ratio is about 0.30, corresponding to 677 pounds of cement added to the slurry mixer. Accordingly, there is need for method and means to achieve enhanced fluidity of the slurry in the slurry mixing vessel.

SUMMARY OF THE INVENTION

It is a major object of the invention to provide method and apparatus meeting the above need.

Accordingly, it is one object of the invention to provide a fluidity enhancing method that includes a) providing a container for the slurry and effecting movement of the slurry, in the container, and b) transmitting vibration to the moving slurry.

Such vibration transmission to achieve enhanced slurry flowability is not obvious, since non-moving water and cement in a vessel do not mix well or stay in suspension in the presence of low or high frequency vibrations, the cement tending to settle downward, as the water tends to rise, creating separation.

It is another object to transmit vibration into a moving mix of aqueous cementitious material such as Portland cement and water, in a mixing vessel, to achieve enhanced flowability and lowered water/cement ratio. Typically, the container or vessel has a wall adjacent which the slurry moves, and such vibration is transmitted to the slurry via the wall or directly into the slurry. In this regard, the vibration transmission into the slurry which travels downwardly to a discharge, can be adjusted to achieve or increase the enhancement effect. A metallic channel is typically attached to the outer vessel wall, and a vibrator is attached to the channel at a selected location along its length, to achieve such adjustment. Vibration is also typically transmitted to the downwardly swirling slurry at two different levels, and at opposite sides of the vessel, as will be seen.

A further object is to induce swirling of the slurry by operation of an impeller at the central downward discharge from the vessel, below the level of vibration transmission into the slurry. A stirring device may be provided and rotated in the vessel in conjunction with rotation of the impeller, to further mixing and flowability of the slurry at the point of discharge.

Yet another object is to transmit such vibration to the slurry at a frequency or frequencies of between 1,200 and 10,000 cycles per minute.

An additional object is to optimally recirculate the vibrated slurry to an upper level in the vessel, the enhanced fluidity of the treated slurry preventing clogging in the recirculating line. Such recirculation aids in mixing of slurry in the vessel.

An additional object is to transmit sufficient vibration into moving aqueous cementitious slurry to lower the water/cement ratio to about 0.30, or less, for water temperature or temperatures from below 100° F. up to 190° F.

Yet another object is to locate one or more such vibrators in the vessel interior while the slurry swirls about the vibrator or vibrators, which preferably are suspended and directed generally downwardly. In this regard the vibrator or vibrators may be suspended to pivot in response to swirling slurry contact with the vibrator or vibrators.

A yet further object is to provide rotary vibration inducing elements at the vibrators, and to transmit rotation downwardly from drivers to such elements at the vibrators. In this regard, the vibrators may be allowed to pivot independently of, and in response to swirling of the slurry in the vessel, acting to deflect the vibrations. Such vibration inducing elements may preferably comprise eccentric rotors contained within protective non-rotary sheaths defined by the vibrators.

Vibration as disclosed serves to enhance fluidity of the slurry thereby enhancing its capability for recirculation from the lower interior of the vessel to the upper interior of the vessel, for example if recirculation is employed, as via a recirculation line, without clogging of that line.

These and other objects and advantages of the invention, as well as the details of an illustrative embodiment, will be more fully understood from the following specifications and drawings, in which:

DRAWING DESCRIPTION

Figure 3:
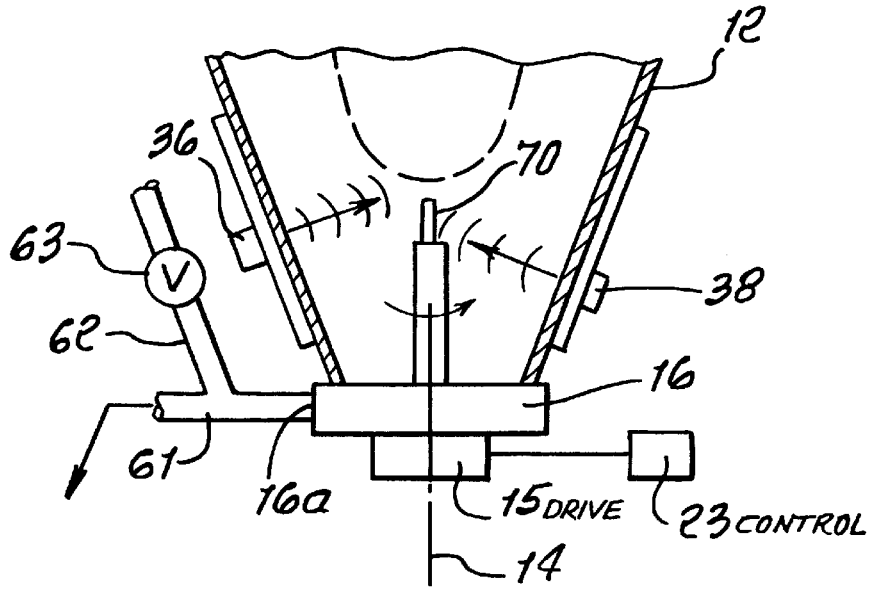
FIG. 3 is an enlarged fragmentary view showing a further modification.
Figure 3A:
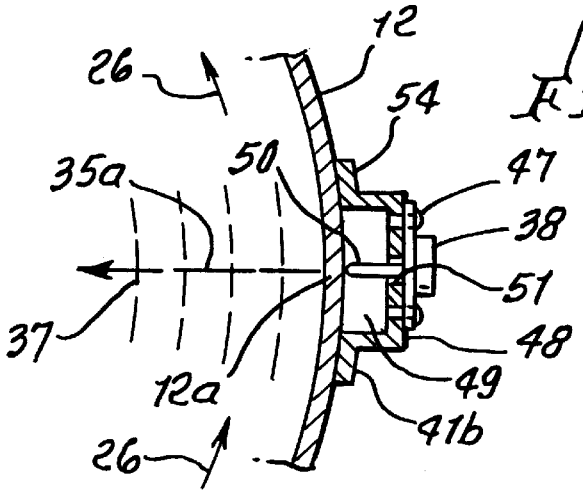
Figure 4:
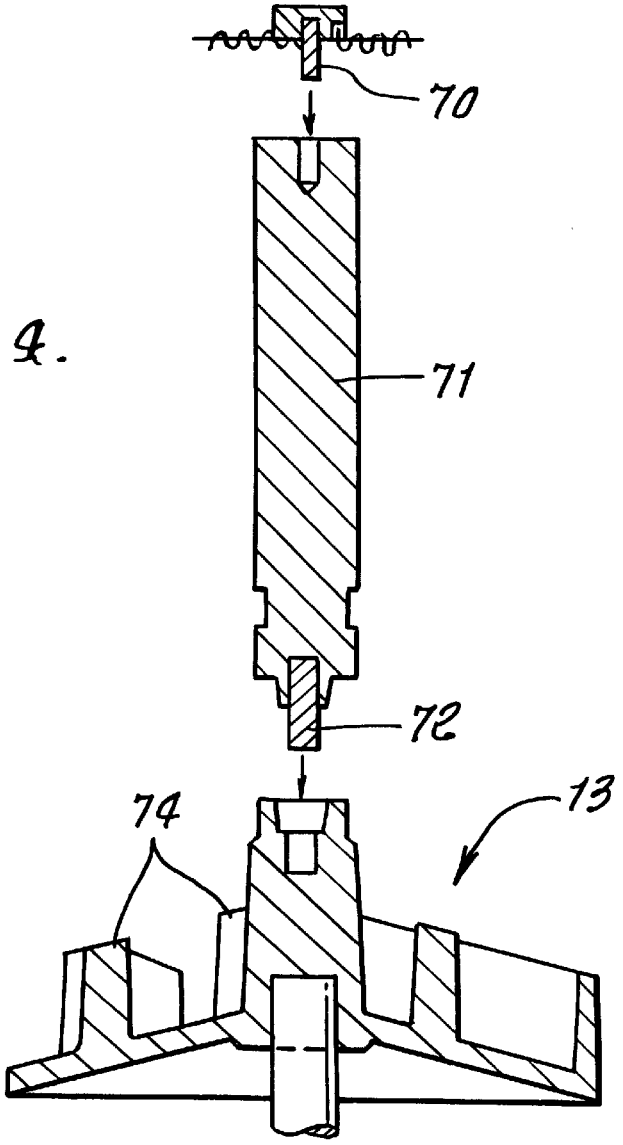
Figure 5:
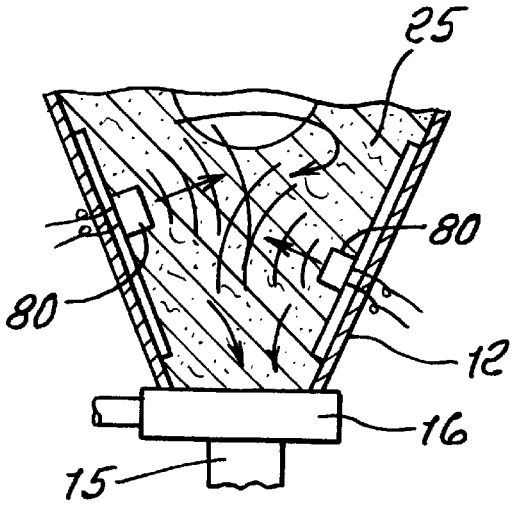
Figure 6:
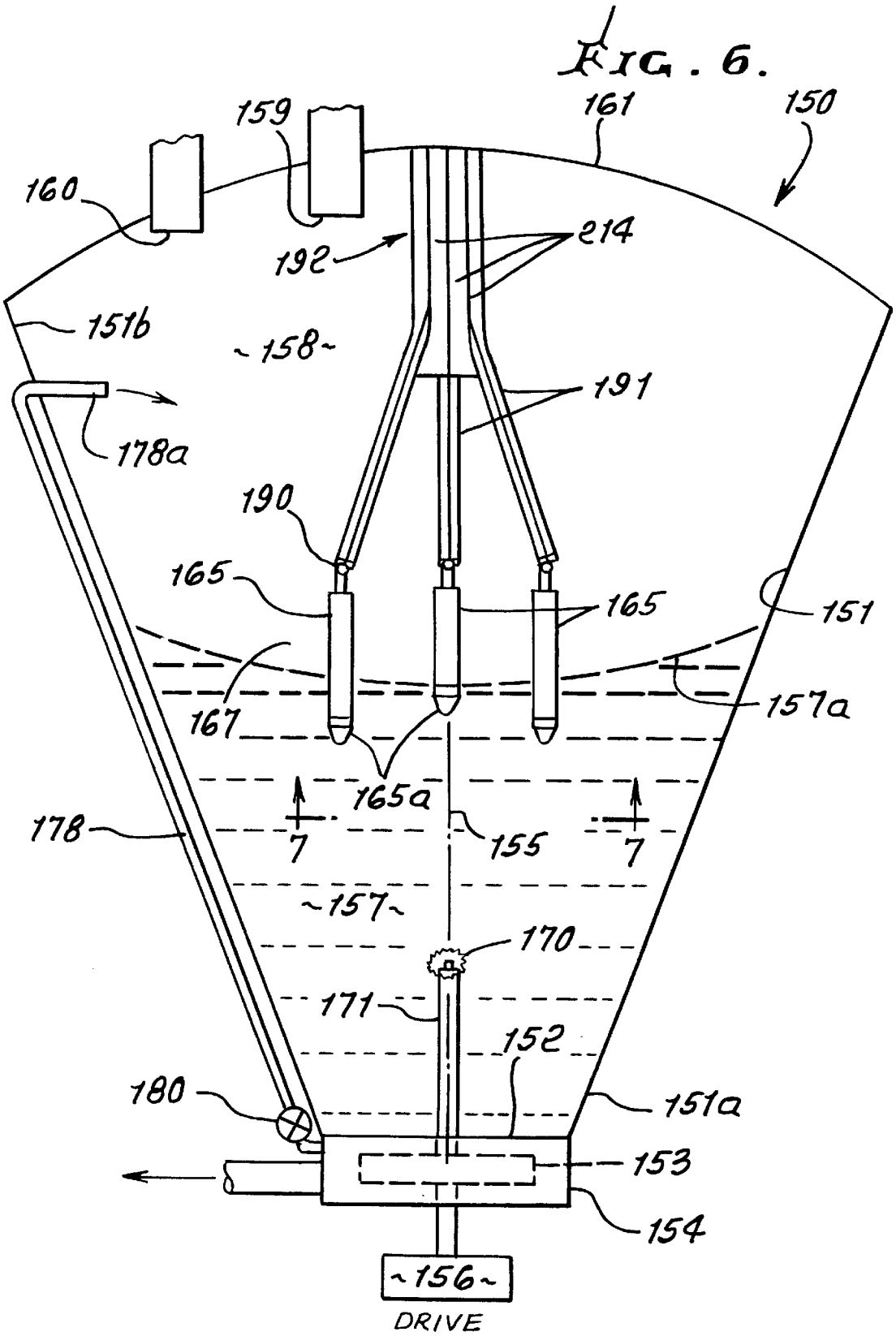
Figure 10:
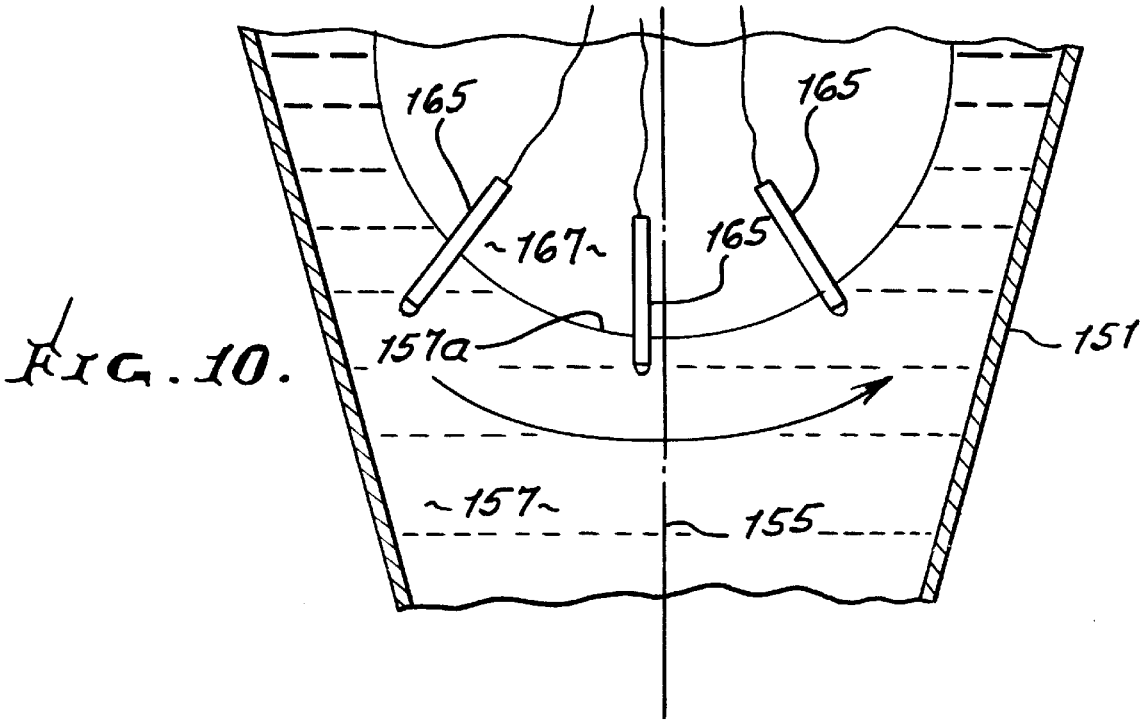
Figure 12:
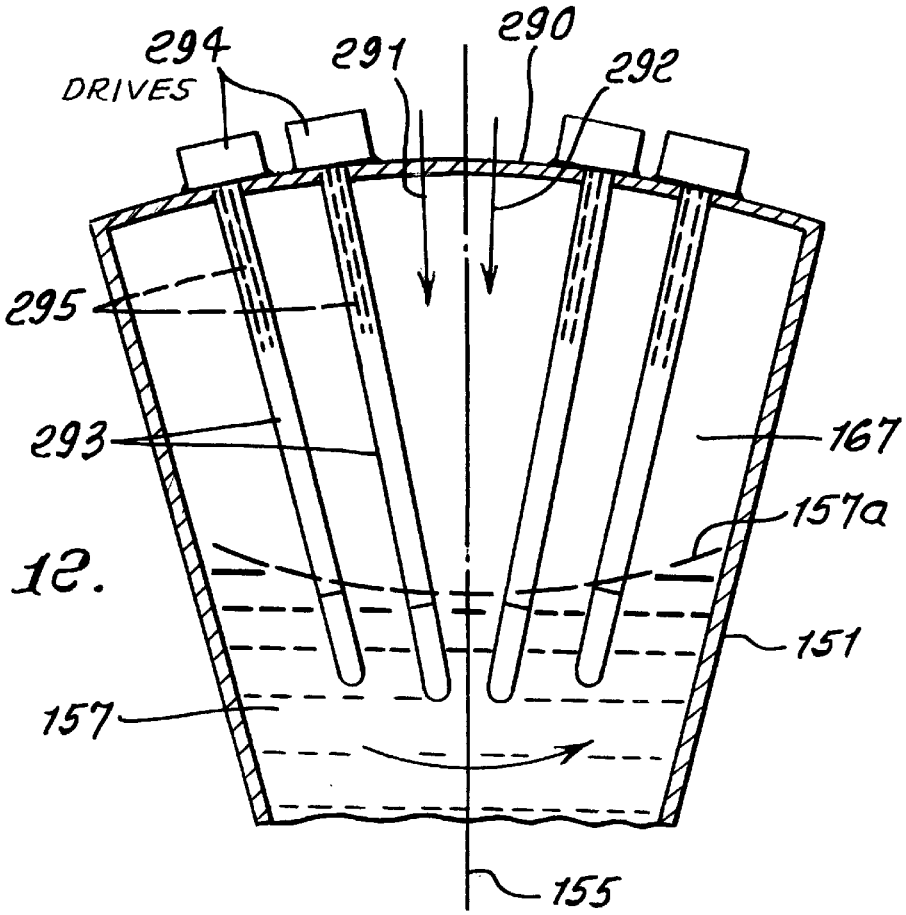
Figure 11:
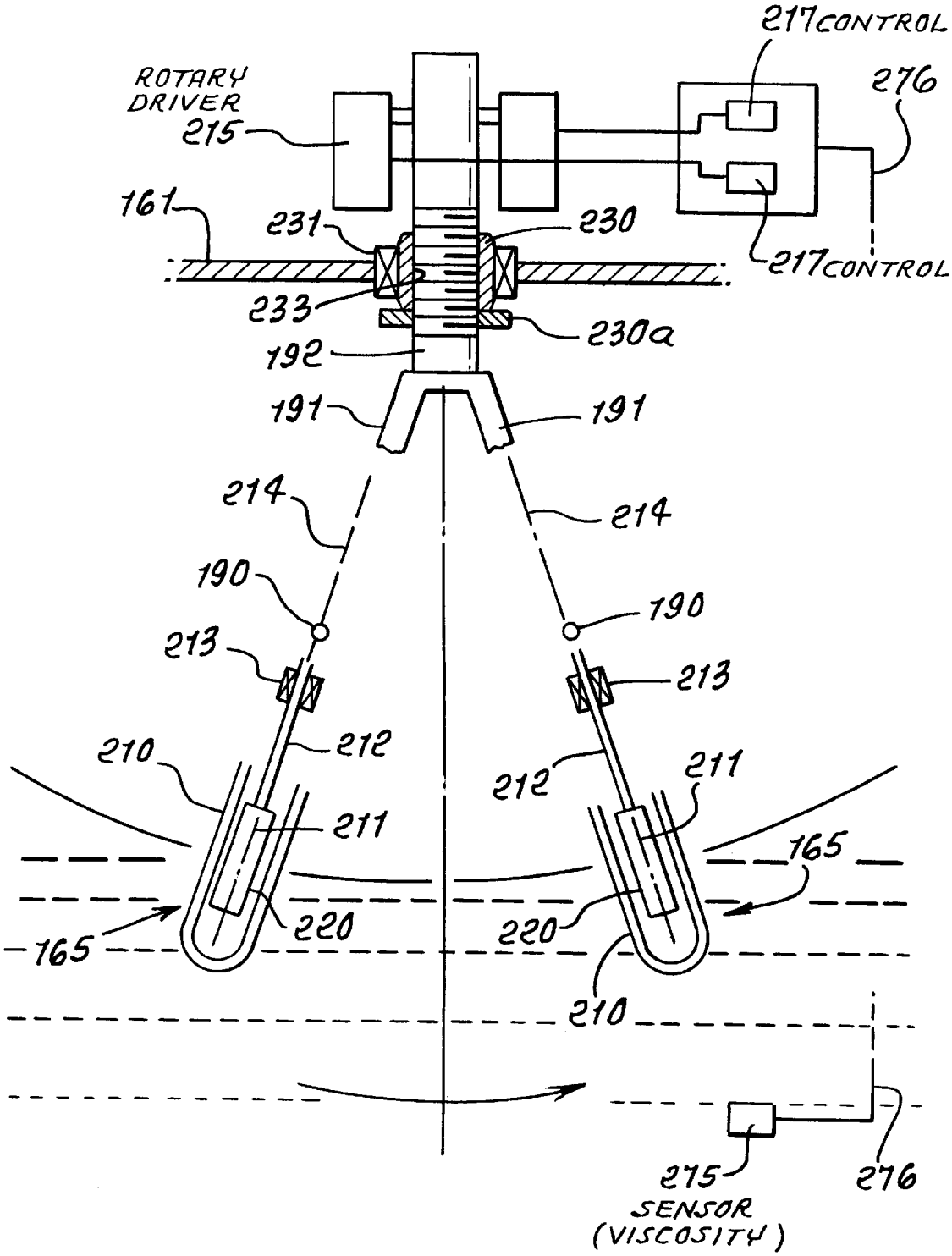

FIG. 3*a* is an enlarged section taken on lines 3*a*—3*a* of FIG. 3;

FIG. 4 is an enlarged view showing an impeller for driving a mixing paddle;

FIG. 5 is an enlarged fragmentary view showing yet another modification;

FIG. 6 is a view showing a mixing vessel with multiple vibrators suspended therein;

FIG. 7 is a bottom plan view taken on lines 7—7 of FIG. 6;

FIG. 8 is a view like FIG. 7 showing three vibrators instead of four;

FIG. 9 is a plan view of a gland, allowing vibrator pivoting;

FIG. 10 is a fragmentary view, showing suspended vibrators having been pivoted outwardly in response to contact with swirling slurry;

FIG. 11 is a diagramatic view showing separate control of vibrator drivers, whereby vibration at different frequency or intensity levels may be transmitted to the swirling slurry, and at different zones in the vessel; and FIG. 12 is an elevation showing a yet further modification.

DETAILED DESCRIPTION

Figure 1:
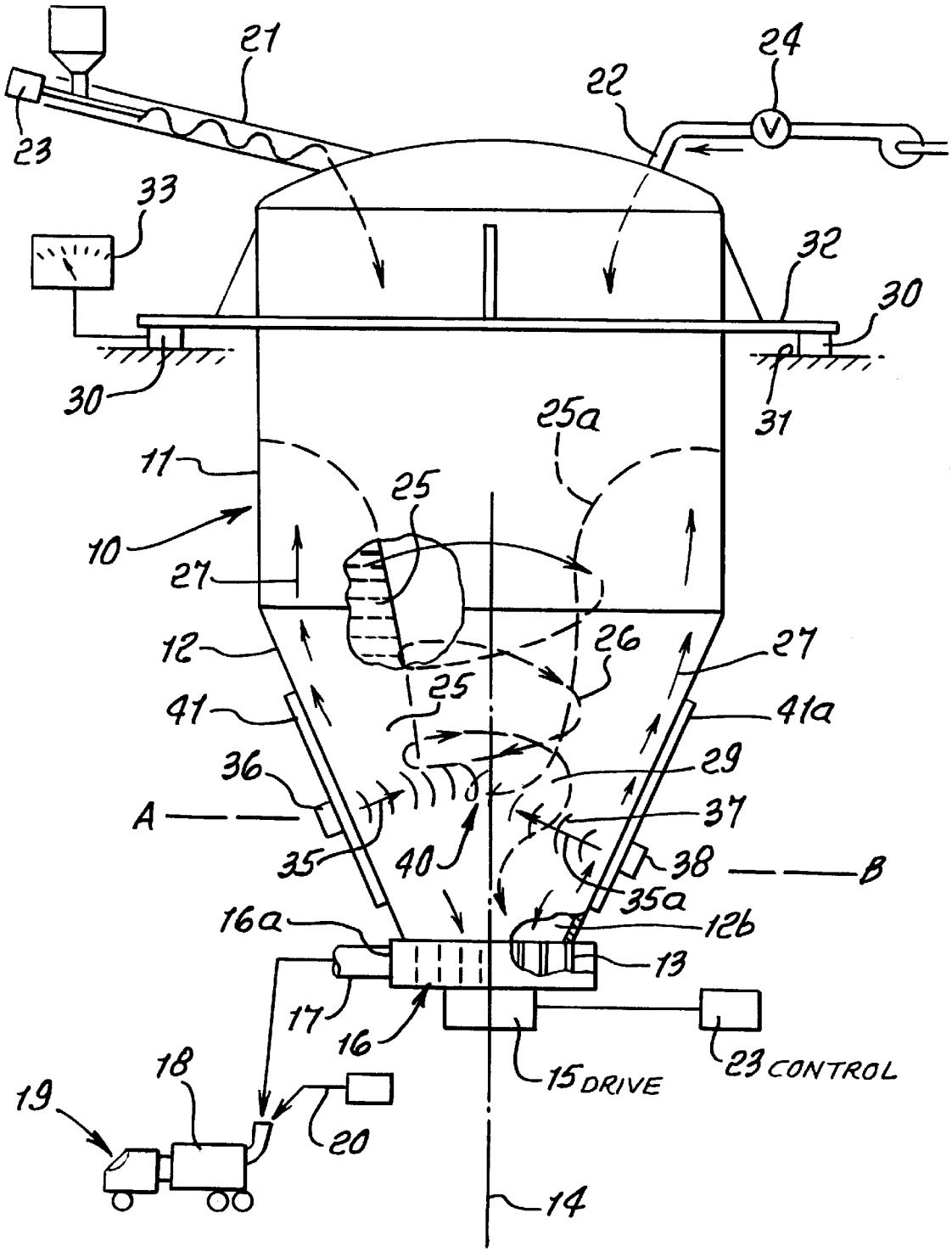
FIG. 1 is an elevation showing slurry mixing apparatus, with vibratory input.

Referring first to FIG. 1, a mixing vessel 10 has an upper cylindrical metallic wall section 11, and a lower conical wall section 12. Section 12 has a lower central discharge opening downwardly at 12*b* into an impeller 13 rotated about central vertical axis 14, as by a drive or motor 15. The latter is located beneath impeller housing 16. Slurry is discharged downwardly into the "eye" or center of the rotating impeller, the housing 16 having a side outlet at 16*a* for discharge of mixed cementitious slurry to a duct 17 leading to a rotating concrete mixer 18 on a truck 19. Wet sand and aggregate are also fed to the mixer 18, at 20.

Dry Portland cement is fed as at 21 to the vessel 10, and water is fed at 22. The cement screw 22 is controlled at 23, and the water delivery is controlled as by a valve 24, to deliver water and cement in the correct proportions to the upper interior of vessel 10, for mixing therein. Rotation of the impeller 13 is controlled by control 23 for the motor 15, to cause the impeller to induce rotation of the slurry 25 in the vessel, the slurry flow spiraling downwardly as indicated at 26, toward the outlet 12*b*, for flow into the impeller.

Some upward recirculation of slurry from lower region 29 can, or does, occur as indicated by arrows 27 adjacent the inner sides of the vessel walls.

A vortex is created by the rotating slurry, whereby the rotating slurry is centrifugally urged toward the vessel wall, creating a central "well" or open region, inwardly of broken line 25*a*, which has the shape of an inverted dome. Mechanism to weigh the vessel and its contents may include the transducers or load cells 30 supported at 31, and supporting a horizontal flange 32 attached to the vessel. See weight indicator 33, and by which the amount of cement and water in the vessel may be determined for batch volume control.

In accordance with the invention, vibration is transmitted into the moving slurry in vessel, as for example sidewardly into the spiraling mass of slurry 25. See the vibratory waves or pulsations transmitted at 35 into and in the slurry from at least one vibration source 36 at one level. Preferably vibrating waves or pulsations are also transmitted at 37 into the slurry from another vibration source 38 at a different (lower) level, and in a direction toward waves 35 to produce at least some interference effect, for increasing the effectiveness of the waves to enhance mixing of cement and water, including wetting of cement particles. The interference zone is indicated at 40. For this purpose, vibration source, i.e. vibrator 36 may be located at one side of the vessel lower interior; and vibration source or vibrator 38 located at the generally opposite side of the vessel, as shown. Also the relative levels of the vibrators may be adjusted, or "tuned" to optimize resultant enhancement of mixing for creation of enhanced fluidity of the mix, below the lowermost level of the inverted dome defined by broken line 25*a*, and above the discharge outlet.

In the example shown, the vibrator may be carried by channel structure 41, attached to the vessel conical wall as shown, to extend generally downwardly, and sidewardly. Two such channels 41 and 41*a* are shown.

FIG. 3*a* shows attachment of channel flanges 41*b* to the vessel wall 12. Vibrator 38 is removably attached as by fasteners 47 to the channel wall 48 spaced at 49 from the vessel wall. The vibrator may have a reciprocating armature 50 which extends to wall 12 to transmit vibration to local region 12*a* of wall 12, and resultant vibrating pulsations are transmitted as at 35*a*, cross-wise of the slurry flowing in a spiral path as indicated by arrows 26. The channel wall 48 has an opening 51 to pass the armature, and there may be a series of such openings spaced apart up and down the channel length, and on wall 48, whereby the vibrator may be selectively located at different of the openings 51 to raise or lower the level of vibration transmission into the swirling slurry, for enhancement of mixing and increase of slurry fluidity.

In this regard, one usable vibrator is MODEL SFC-100, a product of Vibco, Inc. Such a vibrator operates at about 4 amps at 115/230 volts. If desired, the vibrator may simply vibrate the channel, i.e. armature 50 can be omitted. Vibrator flanges 54 are attached by fasteners to the channel wall. Typical vibrator frequencies are between about 1,200 and 4,000 cycles per minute. The channel may be sized to induce resonant or near resonant vibration transmission The objective is to improve Portland cement and water slurry mixing characteristics by lowering of the water/cement ratio from 0.40 to 0.45 at up to 100° F. water temperature, to or below 0.30 (or about 0.30) for water temperatures ranging from below 100° F. to 190° F.

Examples of comparative water/cement ratios for such water temperatures are as follows:

| W/C RATIO | BATCH WATER YDS.$^3$ GALLONS, LBS. | ALLOWABLE CEMENTITIOUS MATERIAL THRU VESSEL, LBS/YDS.$^3$ |
|---|---|---|
| .40 | 24–200 | 500 |
| .30 | 24–200 | 661 |
| .40 | 19–158 | 395 |
| .30 | 19–158 | 526 |
| .40 | 15–125 | 312 |
| .30 | 15–125 | 417 |

This represents a major improvement, in that more Portland cement, relative to water, can be mixed in the vessel, for flow to the concrete delivery truck.

Figure 2:
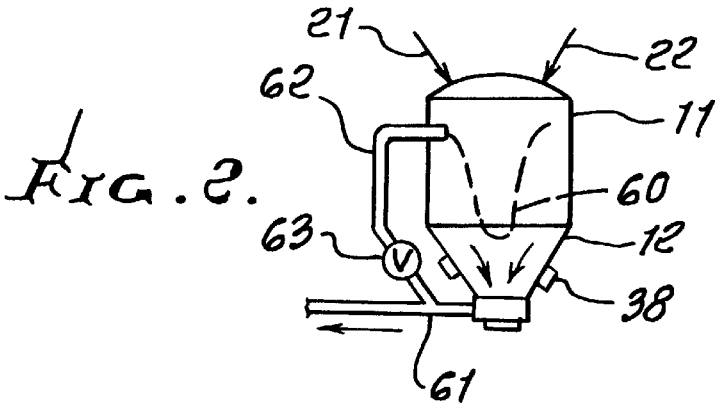
FIG. 2 is an elevation showing a modification.

FIG. 2 shows a mixed slurry recirculation at 60 from the impeller discharge zone 61 to the upper interior of the vessel, as via line 62 containing a flow control valve 63. Valve 63 may be opened if recirculation is desired, or may be used to control the amount of recirculation. The line 62 discharges tangentially to the direction of slurry swirl flow, to aid such swirl flow, for further enhanced mixing. See also U.S. Pat. No. B 1 4,830,505. Vibration enhanced fluidity of the mix assures that the flow in line 62 will not become clogged.

FIGS. 3 and 4 show the optional provision of a mixing device such as a stem, or paddle 70 carried by the rotating impeller or motor driven shaft to project upwardly, on a stem 71, into the lower interior of the vessel, above outlet 12*b*. Rotation of the paddle at impeller speed, i.e. at an RPM greater than the slurry swirl rotary cycle speed, causes enhanced mixing movement and helps to prevent slurry clogging at the point of discharge downwardly into the impeller. A key 72 couples stem 71 to the impeller hub. Note impeller vanes 74 projecting upwardly to induce mix swirling.

FIG. 5 shows vibrators 80 installed at the inside of the vessel lower interior to transmit vibration directly into the moving slurry.

Referring now to FIGS. 6–9, the illustrated mixing vessel 150 has a side wall 151 that is upwardly flaring, for example generally conical, from its truncated lowermost extent 151*a* to its truncated uppermost extent 151*b*. A bottom opening or outlet at 152 delivers mixed slurry downwardly to an impeller 153 within cylindrical housing 154. The impeller is rotated about a vertical axis 155, as by driving apparatus 156 typically including an electrical motor. Rotation of the impeller induces swirling of the slurry mix in the vessel about axis 155, to form a downwardly concave upper surface 157*a* of the mix 157. Water and cementitious material are typically introduced into the vessel interior 158, through openings 159 and 160 in top wall 161 of the vessel. Such material may consist of any of the following: cement, Portland cement:, fly ash, silica fume, and slag.

In accordance with an important aspect of the invention, at least one vibrator, and preferably multiple vibrators, are provided or located within the interior of the vessel, and operated to transmit vibration to the moving slurry in the vessel. As shown, multiple vibrators 165 are provided in inwardly spaced relation from the vessel wall 151, i.e. spaced from that wall, and are spaced generally radially about and outwardly from central axis 155. This enables the vibrations to penetrate the mass of the rotating or swirling slurry, despite formation of the downward vortex open space 167 directly above the downwardly concave and rotating slurry mix surface 157*a*. The vibrators could be placed at other locations in the vessel.

As shown, the generally vertically elongated vibrators preferably extend downwardly so that their vibrating lower end portions 165*a* are free to penetrate the slurry, even though slurry level 157*a* may rise or fall, for transmitting vibrations to the slurry.

A further feature of the invention concerns the provision for pivoting of the vibrators 165, for example away from vertical axis 155, for example between 20° and 90°, in response to rotary movement of the slurry about axis 155, centrifugal force developing in the slurry also acting on the vibrators penetrating the slurry, to swing them outwardly, as for example to the positions shown in FIG. 10. Typical pivot locations appear at 190, below "tree" or frame structure arms 191. A sealing gland for a line 214 to the vibrator is shown at 285, in FIG. 9. The gland has a gasket 214*a*, which may for example consist of elastomeric material, that facilitates pivoting, as described. A main vertical support for the frame access appears at 192. Such structure tends to maintain the vibrators in optimum or near optimum vibration transmitting relation to the slurry, to maintain desired fluidity. Also, since the outwardly swung vibrators are then closer to the vessel wall, any tendency of the slurry to cling to the inner surface of the wall is reduced by enhanced vibration transmission to or toward such wall inner surfaces. In this regard, the swung or angled positions of the vibrators are self adjusting in accordance with the degree of slurry vortex formation.

FIG. 7 shows provision of four vibrators 165 spaced at equal angular (90°) positions about axis 155; and FIG. 8 shows the provision of three vibrators 165 spaced at equal angled (120°) positions about axis 155. FIG. 6 shows a mixing device, as for example relatively small paddle 170 carried at 171, above outlet 152, and operable i.e. rotatable by the impeller, to stir the slurry being delivered to the outlet, as previously described. Highly fluidized slurry pumped by the impeller 153 may be optimally recirculated via line 178 upwardly to the open upper interior 158 of the vessel, to rejoin slurry being mixed in the vessel; this enhances the overall fluidity of the uppermost regions of the slurry in the vessel, to which cement and water are downwardly delivered, via the top of the vessel. A valve 180 may be incorporated in line 178 to control the amount of mixed slurry being re-circulated. Outlet 178*a* from line 178 may be directly into the slurry, in the vessel.

By virtue of the use of such vibrators, fluidity of the slurry is desirably enhanced to the extent that the water/cement ratio of the moving and vibrated slurry may be reduced to levels below, or substantially below 0.30, for water temperature below about 100° F. This in turn produces attendant substantial advantages in slurry delivery to, and flow within, a rotating transport drum as on a truck, and lessened need for dry dusty cement addition to the drum as make-up to attain desired water/cement ratio in the cement/water and aggregate mix in the rotating drum. In this regard, cement dust escaping to the exterior environment is thereby substantially reduced. This potentially aids in reducing silicosis.

Referring now to FIG. 11, it shows in somewhat schematic form one preferred form of vibrator support and actuation. The vibrators 165 include outer sheaths or tubular structure 210, pivoted at 190, from arms 191, as via the gland described above. Each vibrator includes an eccentric weight 220 carried to rotate within the sheath or shell and transmit lateral vibration to the latter. The axis of rotation is indicated at 211, and defined by a rotating stem 212 supported by bearing 213. A flexible shaft 214 extends downwardly from a rotary driver 215, which may include an electric motor, the lower end of the flexible shaft connected to stem 212, and allowing pivoting of the vibrator, as described. The rotational speeds of the drivers are collectively or individually controllable, as at 217, and the vibrations may be located at different levels, if desired.

The vertical support or strut 192 is centrally carried by the top wall 161 of the vessel 150; and provision may be made for up and down adjustment of the strut position, to thereby adjust the vertical positions of the vibrators relative to slurry in the vessel. Merely as illustrative, an adjustment nut 230 may be supported for rotation by bearing 231 carried by top wall 161. The nut is shown to have threaded engagement at 233 with the strut 192, whereby rotation of the nut moves the "tree" including strut 192 up or down. An adjustment ring 230*a* on the nut 230 may be manually rotated, or suitable driven.

A slurry viscosity sensor 275 incorporating a transducer may be located in the swirling slurry to sense its viscosity; and a feedback line 276 to the vibrator driver control may be provided, whereby the vibrators are driven at a vibration rate to maintain the slurry viscosity (related to fluidity) within a desired range.

FIG. 12 shows a modification wherein elements 151, 155, 157, 157*a* and 167 are the same as in FIG. 10. The vessel top wall appears at 290. Supply of cementitious material and water is designated by arrows 291 and 292. Vibrator elements 165 are like those as previously described, excepting that their support is modified. Elongated rigid pipes or tubes 293 support the elements 165, and project downwardly and angularly from the top wall 290. The upper ends of tubes 293 may be rigidly connected to wall 290, or may be carried by drive units 294 the housings of which are connected to wall 290, as shown. Units 294 rotatably drive shafts 295 within tubes 293 and which extend to the vibrators to effect rotation of internal parts creating vibration transmitted to the slurry 157.

Mixing vessels as referred to above may take various forms and shapes, and encompass zones where mixing takes place, as referred to.

I claim:

1. The method of treating an aqueous, cementitious slurry, to enhance fluidity, that includes:

a) providing a vessel for the slurry and effecting movement of the slurry, in the vessel, the vessel having an interior, and b) locating at least one vibrator in the interior of the vessel, and operating said at least one vibrator to transmit vibration from within the vessel to the moving slurry, to lower the water/cement ratio to or below about 0.30.

2. The method of claim 1 including providing multiple vibrators in the vessel interior and which are operated to transmit vibration to the moving slurry.

3. The method of claim 2 including downwardly suspending said multiple vibrators in the vessel interior, to pivot when contacted by slurry moving in the vessel.

4. The method of claim 2 including directing said multiple vibrators generally downwardly in the vessel interior.

5. The method of claim 4 including providing and operating a mixing device to displace said slurry at a location below the level of said downwardly directed vibrators in the vessel interior.

6. The method of claim 5 wherein the slurry consists essentially of water and Portland cement.

7. The method of claim 4 wherein the slurry consists essentially of water and Portland cement.

8. The method of claim 2 including locating said multiple vibrators at laterally spaced locations above a slurry outlet from the vessel.

9. The method of claim 2 wherein the slurry consists essentially of water and Portland cement.

10. The method of claim 2 including controlling the vibration transmitted by said vibrators.

11. The method of claim 10 including providing rotary drivers above the levels of said vibrators, and slurry, providing rotary vibration inducing elements at said vibrators, and transmitting rotation downwardly from said drivers to said elements.

12. The method of claim 11 including allowing said vibrators and elements to pivot independently during said rotation transmission, and in response to slurry swirling in the vessel acting to deflect the vibrators.

13. The method of claim 1 including downwardly suspending said at least one vibrator in the vessel interior, to be contacted by moving slurry being fluidized in the vessel.

14. The method of claim 13 including providing an eccentric weight operatively connected with said vibrator and rotating said weight to induce vibration transmission by the vibrator to said slurry in the vessel, said vibration being induced while the vibrator remains free to pivot, in the moving said slurry.

15. The method of claim 1 including directing said at least one vibrator generally downwardly in the vessel interior.

16. The method of claim 15 including providing and operating a slurry mixing device in the slurry at a location below the level of said at least one downwardly directed vibrator in the vessel interior.

17. The method of claim 1 wherein the slurry consists essentially of water and Portland cement.

18. The method of claim 1 including removing said slurry from said vessel via an outlet at the bottom of said vessel, and recirculating at least some of said slurry upwardly to a level in the vessel above said at least one vibrator.

19. The method of claim 1 including providing vibrating means in association with said vibrator and rotating said means to induce vibration transmission by the vibrator to said slurry in the vessel.

20. The method of claim 19 including providing a protective non-rotary sheath to extend about such vibrating means.

21. The method of claim 1 including providing multiple vibrators projecting into the slurry, and providing elongated supports for the vibrators, said supports carried by the container.

22. The method of treating an aqueous, cementitious, slurry, to enhance fluidity, that includes:

a) providing a container for the slurry and in which the slurry is moving, and b) transmitting vibration to the slurry, to enhance fluidity thereof and to reduce the water/cement ratio of the slurry, c) sufficient vibration being transmitted into the moving slurry and from within the container to lower the water/cement ratio to or below about 0.30.

23. The method of claim 22 wherein the container has a wall adjacent which the slurry moves, and said vibration is transmitted to the slurry via the wall.

24. The method of claim 23 including shifting the location of vibration transmission, along said wall.

25. The method of claim 24 including providing a channel adjacent the wall at the side thereof opposite the slurry, and shifting vibration transmission along the channel.

26. The method of claim 25 wherein said channel is sized to produce resonance or near resonance vibration with respect to the channel and container.

27. The method of claim 25 including providing a vibrator means to produce said vibration, and adjustably attaching said vibrator means to the channel.

28. The method of claim 23 wherein said movement of the slurry is effected in a downwardly flowing pattern, said vibration being transmitted to the moving slurry.

29. The method of claim 28 wherein said vibration is transmitted to the slurry at at least two locations at different levels.

30. The method of claim 29 wherein said vibration transmitted at said two locations is generally oppositely directed into the slurry.

31. The method of claim 30 wherein said vibration transmission is at a frequency or frequencies within the range 1,200 to 10,000 cycles per minute.

32. The method of claim 28 including inducing said slurry movement via a rotating impeller toward and into which the slurry flows, downwardly.

33. The method of claim 32 including also stirring the slurry at a location immediately above the impeller, and in the path of slurry flow toward the impeller.

34. The method of claim 33 including providing a mixing device at said location, and rotating said device in conjunction with rotation of the impeller.

35. The method of claim 34 wherein said device is caused to project upwardly at said location, and below the level of said vibration transmission into the swirling slurry.

36. The method of claim 32 wherein the impeller has a discharge, and including the step of recirculating some of the vibration treated slurry from the impeller discharge to the upper interior of the container, to further slurry mixing in the container.

37. The method of claim 28 wherein said vibration is transmitted directly into the slurry.

38. The method of claim 37 including locating vibrating means within said container containing the swirling slurry for transiting said vibration.

39. The method of claim 22 including adjusting the location of vibration transmission.

40. The method of claim 39 wherein sufficient vibration is transmitted into the slurry at at least two locations to enhance the flowability of the slurry.

41. The method of claim 22 wherein said sufficient vibration is directly transmitted to the moving slurry to enhance fluidity of the slurry.

42. The method of claim 41 wherein the slurry consists essentially of water and Portland cement.

43. The method of claim 22 wherein said vibration is transmitted at a frequency or frequencies within the range 1,200 to 10,000 cycles per minute.

44. In apparatus for treating an aqueous, cementitious slurry, to enhance fluidity, the combination that includes:

a) a container for the slurry and means effecting movement of the slurry, in the container, and b) other means transmitting vibration from within the container to the moving slurry, to enhance fluidity thereof, and to facilitate lowering of the water/cement ratio to or below about 0.30.

45. The apparatus of claim 44 wherein the container has a wall adjacent which the slurry moves, and said vibration is transmitted to the slurry via the wall.

46. The apparatus of claim 45 including means for adjusting the location of vibration transmission via the wall.

47. The apparatus of claim 46 wherein said means for adjusting vibration transmission includes a channel adjacent the wall at the side thereof opposite the slurry, and said means transmitting vibration includes vibrator means attached to the channel to be shifted therealong.

48. The apparatus of claim 47 wherein said channel is sized to produce resonance or near resonance vibration with respect to the channel and container.

49. The apparatus of claim 45 wherein said movement of the slurry is effected in a downwardly flowing pattern, said other means including vibrator means for inducing vibration being transmitted to the slurry and sidewardly thereof.

50. The apparatus of claim 49 wherein said vibrator means includes at least two vibrators to transmit vibration to the slurry at at least two locations at different levels.

51. The apparatus of claim 50 wherein said vibration transmitted at said locations is generally oppositely directed into the slurry.

52. The apparatus of claim 51 wherein said vibration transmission is at a frequency or frequencies within the range 1,200 to 10,000 cycles per minute.

53. The apparatus of claim 49 including a rotating impeller inducing movement of said slurry downwardly, toward the impeller from within said container and below which said impeller is located.

54. The apparatus of claim 53 including also stirring means for locally and rapidly stirring the slurry, at a location immediately above the impeller, and in the path of said slurry downward movement toward the impeller.

55. The apparatus of claim 54 wherein said stirring means includes a stirring device at said location, said device rotating in conjunction with rotation of the impeller, the device projecting upwardly at said location, and below the level of said vibration transmission into the slurry.

56. The apparatus of claim 53 wherein the impeller has a discharge, and including means for recirculating some of the vibration treated slurry from the impeller discharge to the upper interior of the container, to further slurry mixing in the container.

57. The apparatus of claim 44 wherein said sufficient vibration is transmitted to the moving slurry by vibrator means operated at a frequency to enhance fluidity of the slurry.

58. The apparatus of claim 57 wherein said vibration is transmitted into the slurry at at least two locations to enhance the flowability of the slurry.

59. The apparatus of claim 57 wherein the slurry consists essentially of water and Portland cement.

60. The apparatus of claim 44 wherein said vibration is transmitted at a frequency or frequencies within the range 1,200 to 10,000 cycles per minute.

61. The apparatus of claim 44 wherein said vibration is transmitted directly into the slurry.

62. The apparatus of claim 61 including locating vibrating means within said container containing the slurry, for transmitting said vibration.

63. The apparatus of claim 62 wherein said vibrating means includes vibrators projecting into the slurry for transmitting said vibration, and elongated supports for said vibrators, said supports carried by the container.

* * * * *